US008026453B2

(12) United States Patent
Yasufuku et al.

(10) Patent No.: US 8,026,453 B2
(45) Date of Patent: Sep. 27, 2011

(54) SWITCH

(75) Inventors: Kenji Yasufuku, Fukui (JP); Kenji Nishimura, Fukui (JP)

(73) Assignee: Panasonic Corporation, Osaka (JP)

( * ) Notice: Subject to any disclaimer, the term of this patent is extended or adjusted under 35 U.S.C. 154(b) by 206 days.

(21) Appl. No.: 12/205,964

(22) Filed: Sep. 8, 2008

(65) Prior Publication Data

US 2009/0065334 A1 Mar. 12, 2009

(30) Foreign Application Priority Data

Sep. 7, 2007 (JP) ..... 2007-232329

(51) Int. Cl.
*H01H 13/00* (2006.01)
*H01H 15/00* (2006.01)

(52) U.S. Cl. ..... 200/16 C; 439/83

(58) Field of Classification Search ..... 439/83, 439/874–876, 78, 79; 200/293, 16 A, 16 C
See application file for complete search history.

(56) References Cited

U.S. PATENT DOCUMENTS

| | | | | |
|---|---|---|---|---|
| 5,281,152 | A * | 1/1994 | Takahashi et al. | 439/79 |
| 5,496,180 | A * | 3/1996 | Fabian et al. | 439/60 |
| 6,621,018 | B1 * | 9/2003 | Chen | 200/16 C |
| 6,841,744 | B1 | 1/2005 | Kodo et al. | |
| 7,507,926 | B2 * | 3/2009 | Kawamura et al. | 200/548 |

FOREIGN PATENT DOCUMENTS

| | | | |
|---|---|---|---|
| CN | 2371683 | Y | 3/2000 |
| JP | 06140085 | A * | 5/1994 |
| JP | 2003-297183 | A | 10/2003 |

* cited by examiner

*Primary Examiner* — Felix O Figueroa
(74) *Attorney, Agent, or Firm* — RatnerPrestia

(57) ABSTRACT

A plurality of vertical bends are provided in a terminal projecting from a switch contact outwardly of a case. With this structure, when the terminal is soldered to a land on a wiring board, a plurality of solder layers are formed between the plurality of bends and the land. The plurality of solder layers can enhance the terminal strength, thereby preventing the switch from coming or floating off from the wiring board. Thus, a switch capable of ensuring reliable operation can be provided.

4 Claims, 4 Drawing Sheets

SWITCH

BACKGROUND OF THE INVENTION

1. Field of the Invention

The present invention relates to a switch to be mainly used to operate various types of electronic equipment.

2. Background Art

In the recent promotion of downsizing and enhancing the functionality of various types of electronic equipment, such as a portable telephone and a personal computer, a small, thin switch capable of ensuring reliable operation is also required for operating such equipment.

A description is provided of such a conventional switch with reference to FIGS. 6 through 8.

FIG. 6 is a sectional view of a conventional switch. FIG. 7 is a perspective view of the conventional switch. With reference to FIG. 6 and FIG. 7, case 101 made of an insulating resin has an opening on the top face thereof, and substantially a box shape. Fixed contact 102 is formed of a conductive sheet metal. A plurality of fixed contacts 102 are implanted on the inner bottom face of case 101 by insert molding or the like.

Operating body 103 made of an insulating resin is housed in case 101 so as to be movable horizontally. Operating part 103A is projected from a side face of case 101.

In movable contact 104 made of a resilient sheet metal, the central part thereof is fixed onto the bottom face of operating body 103. In substantially a deflected state, both ends of movable contact 104 are in resilient contact with the central and right ones of fixed contacts 102. Thus, switch contacts are formed.

Cover 105 made of a sheet metal covers the opening on the top face of case 101. Terminals 106 extending from fixed contacts 102 and projecting outwardly from the ends of case 101 are bent upwardly from the base portions thereof. Thus, switch 107 is formed.

FIG. 8 is a sectional view of the conventional switch mounted on a wiring board. With reference to FIG. 8, a plurality of wiring patterns (not shown) are formed on the top and bottom faces of wiring board 108. On the top face of the wiring board, a plurality of lands 109 are provided at intervals each smaller than the dimension of switch 107. On lands 109, the bottom faces of the ends of case 101 and terminals 106 are placed.

Cream solder or the like is applied to the top face of each land 109 and heated to form solder layer 110. By solder layers 110, the plurality of upwardly-bent terminals 106 are electrically connected to lands 109, and mechanically bonded thereto. Thus, the conventional switch is formed.

The thus formed conventional switch is placed behind a control panel (not shown) of electronic equipment so that operating part 103A projects from the control panel. Terminals 106 are electrically connected to the electronic circuits (not shown) of the equipment via the wiring patterns on wiring board 108, or the connectors, leads, or the like (not shown) connected to the wiring patterns.

When operating part 103A is slid in the left direction, movable contact 104 fixed onto the bottom face of operating body 103 moves in the left direction and both ends of the movable contact make resilient contact with the left and central ones of fixed contacts 102. Thus, the switch contacts are changed over. Then, this electrical signal is supplied from terminals 106 to the electronic circuits of the equipment via the wiring patterns or the like, so that various functions of the equipment are switched.

Even when a slightly large force is applied to operating part 103A during such operation, solder layers 110 formed between upwardly-bent terminals 106 and lands 109 prevent terminals 106 from peeling off from lands 109 and prevent switch 107 from coming or floating off from wiring board 108. In other words, in the structure of the conventional switch, the strength of bonding terminals 106 to lands 109, so-called terminal strength, is enhanced by upwardly bending terminals 106 that project outwardly from the ends of case 101 and forming solder layers 110 between terminals 106 and lands 109.

Japanese Patent Unexamined Publication No. 2003-297183 is an example of the known document information on the conventional techniques related to this invention.

However, in the conventional switch, the sizes of solder layer 110 formed between terminal 106 and land 109 are likely to vary with the amounts of applied solder. For this reason, it is difficult to obtain sufficient terminal strength.

SUMMARY OF THE INVENTION

The present invention provides a switch having enhanced terminal strength and capable of ensuring reliable operation.

In the present invention, a switch is formed by providing a plurality of vertical bends in a terminal projecting from a switch contact outwardly of a case. When the terminal is soldered to a land on a wiring board, a plurality of solder layers are formed between the plurality of bends and the land. The plurality of solder layers can enhance terminal strength, thereby preventing the switch from coming or floating off from the wiring board. Thus, a switch capable of ensuring reliable operation can be provided.

DETAILED DESCRIPTION OF THE INVENTION

Hereinafter, a description is provided of an exemplary embodiment of the present invention, mainly using a switch of the sliding operation type as an example, with reference to FIGS. 1 through 5.

Embodiment

Figure 1:
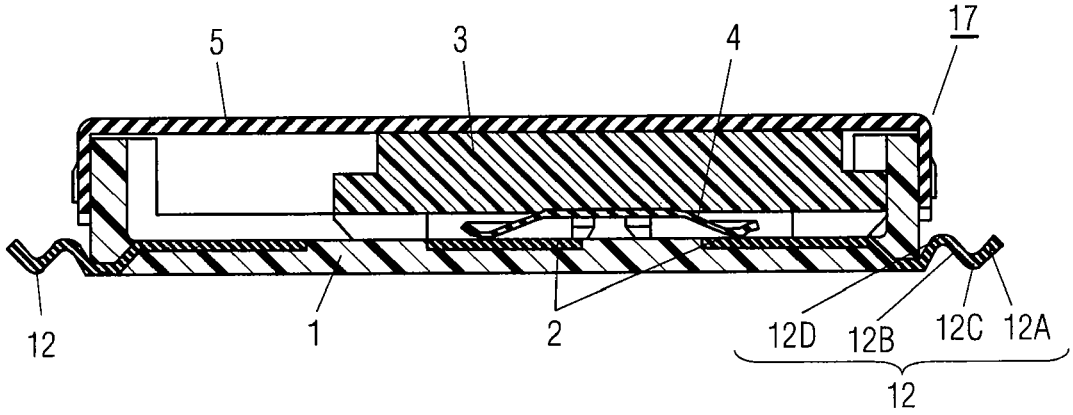
FIG. 1 is a sectional view of a switch in accordance with an exemplary embodiment of the present invention.
Figure 2:
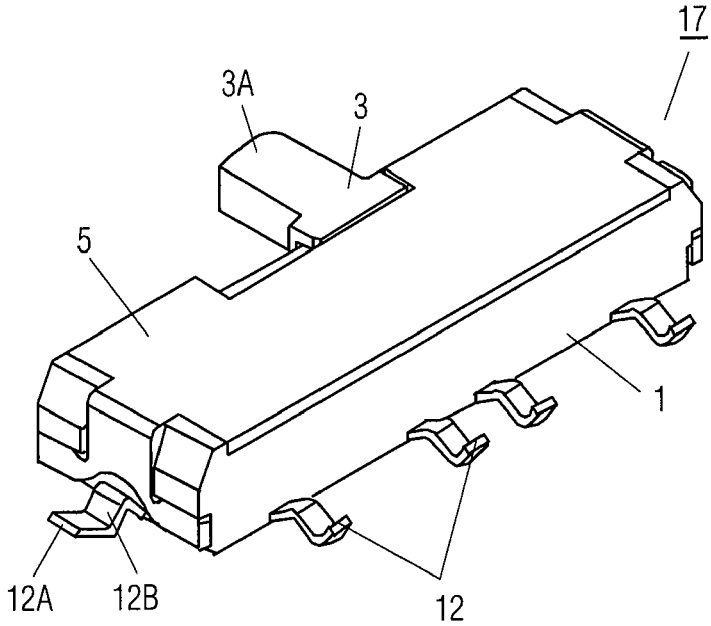
FIG. 2 is a perspective view of the switch in accordance with the exemplary embodiment of the present invention.

FIG. 1 is a sectional view of a switch in accordance with the exemplary embodiment of the present invention. FIG. 2 is a perspective view of the switch in accordance with the exemplary embodiment of the present invention. With reference to FIG. 1 and FIG. 2, case 1 that has an opening on the top face thereof and substantially a box shape is formed of an insulating resin made of liquid crystal polymer, polyphenylene sulfide, or the like. Fixed contact 2 is formed of a conductive sheet metal made of a copper alloy or the like. A plurality of fixed contacts 2 are implanted on the inner bottom face of case 1 by insert molding or the like.

Operating body 3 is formed of an insulating resin made of liquid crystal polymer, nylon, or the like, and housed in case 1 so as to be movable horizontally. Operating part 3A is projected from a side face of case 1.

Movable contact 4 is formed of a resilient sheet metal made of a copper alloy or the like. The central part of the movable contact is fixed onto the bottom face of operating body 3. In substantially a deflected state, both ends of movable contact 4 are in resilient contact with the central and right ones of fixed contacts 2. Thus, switch contacts are formed.

Cover 5 formed of a sheet metal of steel or the like covers the opening on the top face of case 1. In each of terminals 12 extending from fixed contacts 2 and projecting outwardly from the ends of case 1, a plurality of vertical bends 12A and 12B are formed. Thus, switch 17 is formed.

Vertical bends 12A and 12B in each terminal 12 forms substantially a V shape. Bends 12A and 12B opposed to each other in the substantially V shape have substantially an equal length. Each of bent points 12C and 12D is formed at an angle in the range of 30 to 90°, preferably in the range of 50° to 70°.

Further, the length of each of bends 12A and 12B is two to five times the thickness of terminal 12. For example, terminal 12 is 0.1 mm thick and each bend is 0.2 mm to 0.5 mm long.

Figure 3:
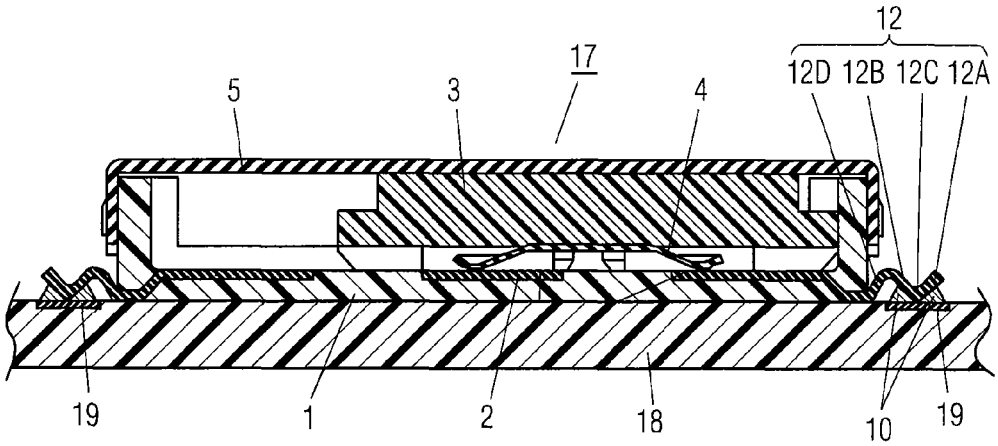
FIG. 3 is a sectional view of the switch in accordance with the exemplary embodiment of the present invention when the switch is mounted on a wiring board.

FIG. 3 is a sectional view of the switch of the exemplary embodiment of the present invention when the switch is mounted on a wiring board. With reference to FIG. 3, a plurality of wiring patterns (not shown) made of a copper foil or the like are formed on the top and bottom faces of wiring board 18 made of paper phenol, glass epoxy, or the like. On the top face of the wiring board, a plurality of lands 19 are provided at intervals each slightly larger than the dimension of switch 17. Terminals 12 are placed on lands 19.

Cream solder or the like is applied to the top face of each land 19 and heated to form solder layer 10. By solder layers 10, the plurality of vertical bends 12A and 12B in each terminal 12 are electrically connected to land 19, and switch 17 is mechanically bonded thereto.

In each terminal 12 that extends outwardly from the end of case 1 and is placed on land 19 provided at intervals each slightly larger the dimension of switch 17, the plurality of vertical bends 12A and 12B are formed. A plurality of solder layers 10 are formed between these bends 12A and 12B and land 19 so that switch 17 is bonded to wiring board 18.

The thus formed switch of the present invention is placed behind a control panel (not shown) of electronic equipment so that operating part 3A projects from the control panel. Terminals 12 are electrically connected to the electronic circuits (not shown) of the equipment via the wiring patterns on wiring board 18, or the connectors, leads, or the like (not shown) connected to the wiring patterns.

When operating part 3A is slid in the left direction, movable contact 4 fixed onto the bottom face of operating body 3 moves in the left direction and both ends of the movable contact make resilient contact with left and central ones of fixed contacts 2. Thus, the switch contacts are changed over. Then, this electrical signal is supplied from terminals 12 to the electronic circuits of the equipment via the wiring patterns or the like, so that various functions of the equipment are switched.

As described above, the plurality of vertical bends 12A and 12B are formed in the plurality of terminals 12 soldered to the plurality of lands 19, and the plurality of solder layers 10 are formed between the bends and lands 19. Thus, even when a slightly large force is applied to operating part 3A during the above operation, this structure can prevent terminals 12 from peeling off from lands 19.

The plurality of vertical bends 12A and 12B are provided in each terminal 12 projecting outwardly from the end of case 1, and the plurality of solder layers 10 are formed between these bends and land 19. This structure enhances the strength of bonding terminals 12 to lands 19, so-called terminal strength. Thus, even with slight variations in the amount of applied solder, this structure can prevent switch 17 from coming or floating off from wiring board 18 and ensures reliable operation.

Bends 12A and 12B opposed to each other in each terminal 12 have substantially an equal length. Bent points 12C and 12D are formed at an angle in the range of 30 to 90°, preferably in the range of 50° to 70°. Such settings can provide more uniform and excellent solder layers 10 between bends 12A and 12B and land 19. Further, the length of each of bends 12A and 12B is two to five times the thickness of terminal 12. Such settings can facilitate bending operation in forming bends 12A and 12B, prevent variations in the bending operation.

Further, the plurality of lands 19 are formed on the top face of wiring board 18 at intervals each slightly larger than the dimension of switch 17, and terminals 12 are placed on and soldered to lands 19. This structure prevents the flux deposited from the cream solder during heating from adhering to the bottom face or side faces of case 1 in proximity to terminals 12.

As shown in FIG. 3, preferably, the inner end of each land 19 on the switch side is disposed in proximity to the pendulum position of bent point 12D of bend 12B.

Such disposition allows excellent formation of solder layer 10 between bend 12B and land 19 and secures the clearance between the end of case 1 of switch 17 and the end of land 19. Thus, this structure further enhances the terminal strength and more securely prevents adhesion of the flux to case 1.

Figure 4:
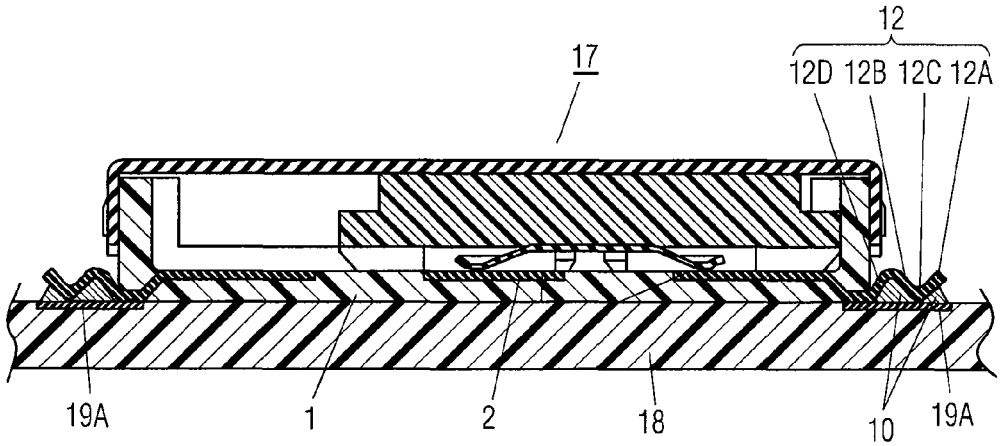
FIG. 4 is a sectional view of another switch in accordance with the exemplary embodiment of the present invention when the switch is mounted on a wiring board.

FIG. 4 is a sectional view of another switch in accordance with the exemplary embodiment of the present invention when the switch is mounted on a wiring board. With reference to FIG. 4, a plurality of lands 19A are provided on the top face of wiring board 18 at intervals each slightly smaller than switch 17, and the bottom faces of the ends of case 1 and terminals 12 are placed on and soldered to lands 19A. Thereby, a plurality of solder layers 10 can be formed to fill all the spaces between a plurality of bends 12A and 12B and lands 19A. This structure can further enhance the terminal strength.

As described above, in this exemplary embodiment, a plurality of vertical bends 12A and 12B are provided in each terminal 12 projecting from a switch contact outwardly of case 1. With this structure, when terminal 12 is soldered to land 19 on wiring board 18, a plurality of solder layers 10 are formed between the plurality of vertical bends 12A and 12B and land 19. The plurality of solder layers 10 can enhance terminal strength, thereby preventing switch 17 from coming or floating off from wiring board 18. Thus, a switch capable of ensuring reliable operation can be provided.

In the above descriptions, bent points 12C and 12D of bends 12A and 12B, respectively, in terminal 12 are formed at an angle in the range of 30 to 90°, preferably in the range of 50° to 70°, and the two opposed sides have substantially an equal length. Further, the length of each side is two to five times the thickness of terminal 12. However, the bent points may be formed at an angle smaller than 30° or larger than 90°, the two opposed sides may have different lengths, or the length of each side may be larger than five times the thickness of the terminal. In these cases, the terminal strength and bending workability are slightly inferior to the case described above.

Figure 5:
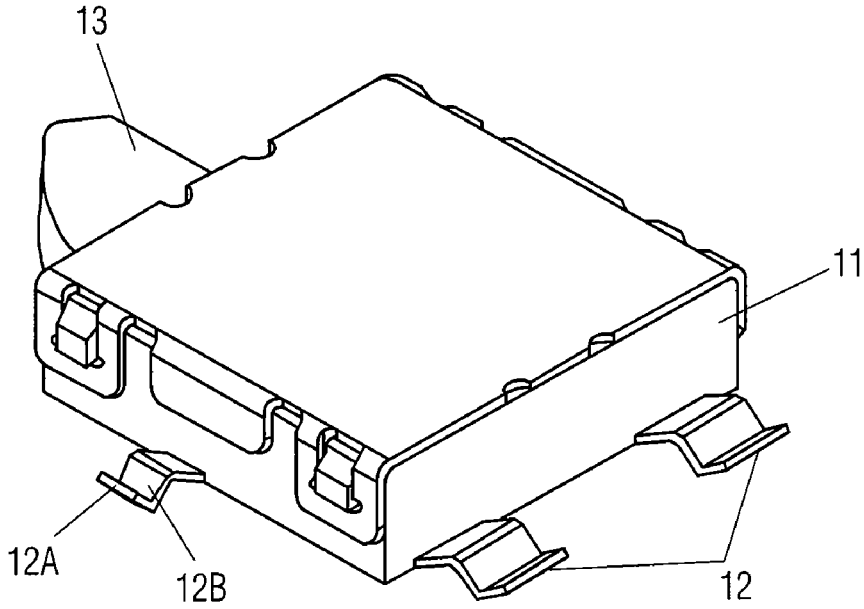
FIG. 5 is a perspective view of still another switch in accordance with the exemplary embodiment of the present invention.
Figure 6:
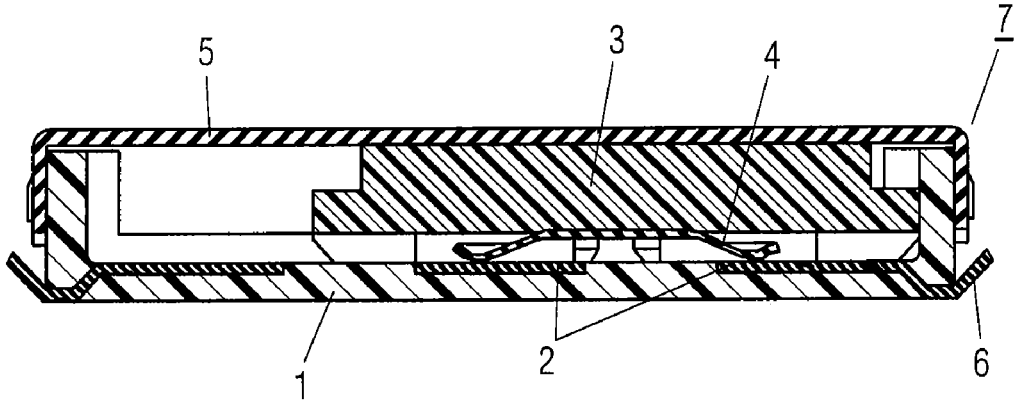
FIG. 6 PRIOR ART
FIG. 6 is a sectional view of a conventional switch.
Figure 7:
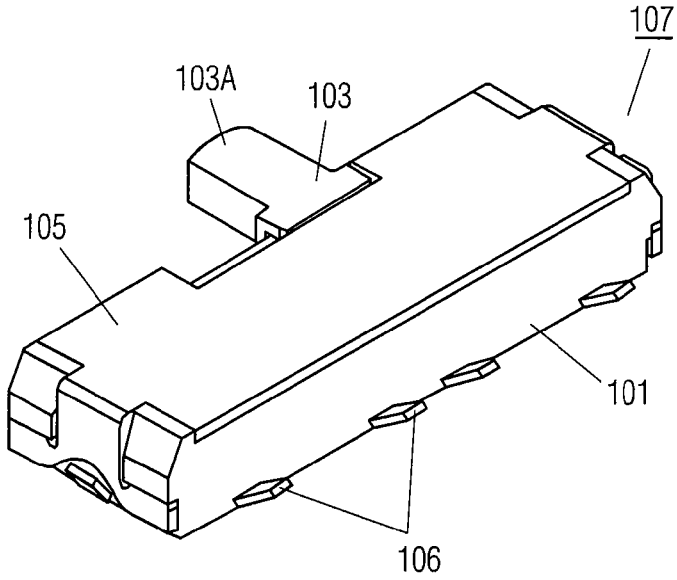
FIG. 7 PRIOR ART
FIG. 7 is a perspective view of the conventional switch.
Figure 8:
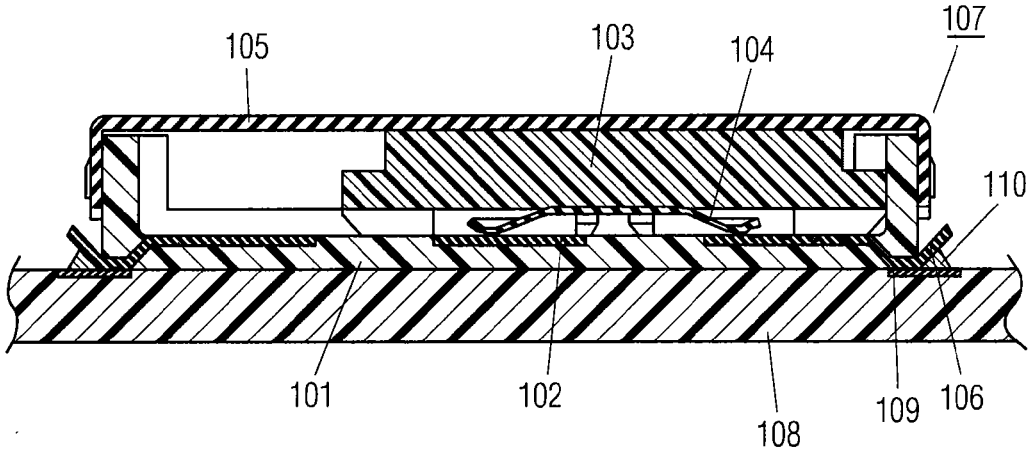
FIG. 8 PRIOR ART
FIG. 8 is a sectional view of the conventional switch mounted on a wiring board.

FIG. 5 is a perspective view of still another switch in accordance with the exemplary embodiment of the present invention. With reference to FIG. 5, the above structure can enhance terminal strength also in a switch of the rocking operation type. The switch has a plurality of vertical bends 12A and 12B in each terminal 12 projecting outwardly from case 51 that houses operating body 53 so that the operating body is rockable. The present invention can be implemented in switches of varies operation types, including the pressing operation type.

The switch of the present invention has enhanced terminal strength and is capable of ensuring reliable operation, and is useful mainly for operating various types of electronic equipment.

What is claimed is:

1. A switch comprising:

a box-shaped case;

an operating body movably housed in the case;

a movable contact moving with the operation body;

a first fixed contact and a second fixed contact, the first and second fixed contacts being brought into and out of electrical contact with each other by the moveable contact by the movement of the operating body; and a terminal portion extending from at least one of the first fixed contact and the second fixed contact to outside of the case, wherein the terminal portion has a first extended section extending up and away from a bottom face of the case, followed by a second extended section extending down, followed by a third extended section extending up.

2. The switch of claim 1 wherein the first extended section, the second extended section, and the third extended section are disposed outside of the case.

3. The switch of claim 1 wherein a first angle between the first extended section and the second extended section, and a second angle between the second extended section and the third extended section are in the range of 30° to 90°.

4. The switch of claim 1 wherein the length of the second extended section and the third extended section is two to five times the thickness of the terminal portion.

* * * * *